United States Patent [19]

Watanabe et al.

[11] Patent Number: 4,802,871

[45] Date of Patent: Feb. 7, 1989

[54] OUTBOARD ENGINE ARRANGEMENT

[75] Inventors: Yoshimi Watanabe; Hiroshi Kawamura; Chiharu Sohda, all of Wako, Japan

[73] Assignee: Honda Giken Kogyo Kabushiki Kaisha, Tokyo, Japan

[21] Appl. No.: 15,167

[22] Filed: Feb. 17, 1987

[30] Foreign Application Priority Data

Feb. 17, 1986 [JP] Japan ..... 61-32638
Feb. 17, 1986 [JP] Japan ..... 61-21387[U]

[51] Int. Cl.[4] ..... B63H 5/13
[52] U.S. Cl. ..... 440/75; 440/88
[58] Field of Search ..... 440/75, 88, 900; 74/336 R, 368

[56] References Cited

U.S. PATENT DOCUMENTS

| | | | |
|---|---|---|---|
| 2,351,050 | 6/1944 | Karey | 440/88 |
| 3,492,966 | 2/1970 | Kiekhaefer | 440/75 |
| 3,727,574 | 4/1973 | Bagge | 440/75 |
| 3,799,291 | 3/1974 | Becker | 440/88 |
| 4,173,939 | 11/1979 | Strang | 440/75 |
| 4,323,354 | 4/1982 | Blanchard | 440/75 |
| 4,331,432 | 5/1982 | Blanchard | 440/75 |
| 4,343,612 | 8/1982 | Blanchard | 440/75 |
| 4,400,163 | 8/1983 | Blanchard | 440/75 |

FOREIGN PATENT DOCUMENTS 53-154592 5/1977 Japan .

*Primary Examiner*—Sherman D. Basinger
*Assistant Examiner*—Stephen P. Avila
*Attorney, Agent, or Firm*—Roberts, Spiecens & Cohen

[57] ABSTRACT

An outboard engine arrangement comprises a transmission for shifting a speed change ratio at least at two stages of higher and lower speeds, the transmission being interposed between a crank shaft of an upper side engine and a drive shaft located coaxilly with the crank shaft for driving a lower side propeller and being contained within an oil pan for the engine, a vertically extending oil feed bore being provided to lubricate the transmission, and means being provided for permitting the oil feed bore to communicate with a bottom in a crank case of the engine.

14 Claims, 2 Drawing Sheets

OUTBOARD ENGINE ARRANGEMENT

BACKGROUND OF THE INVENTION

The present invention relates to an outboard engine arrangement.

In general, in an outboard engine arrangement having an engine disposed at an upper level of the arrangement so that its power may be transmitted to a propeller disposed at a lower level to drive the propeller, a transmission is interposed between the engine and the propeller and the rotational speed of the engine is transmitted to the propeller at a predetermined ratio.

With an outboard engine arrangement provided with such transmission, this transmission and an arrangement for lubricating the transmission are obstacles in providing a compactness for the arrangement. For example, in order to permit different types of navigation for a ship, the tranmission in the outboard engine arrangement must be necessarily constructed of a large size. Also, a space is required to store oil for lubricating the transmission.

In the outboard engine arrangement described in Japanese Utility Model Application Laid-open No. 154592/78, a crank shaft of the engine is directly connected with a drive shaft, so that a given step down ratio between the crank shaft and the propeller is provided by the transmission interposed between the drive shaft and the propeller. In such conventional outboard engine arrangement, if the step down ratio is set at a smaller value to modify the outboard engine arrangement into a higher speed type, it is difficult to navigate the ship at an extremely low speed, whilst if the step down ratio is set at a larger value to modify the outboard engine arrangment into a lower speed type the efficiency of navigation of the ship at a higher speed is reduced. Therefore, it is difficult to control the navigation speed with a single outboard engine arrangement over a wide speed range from an extremely low speed to a high speed.

In general, the lubrication of the transmission is carried out by utilizing an oil splash upon operation of the transmission partially immersed in a lubricating oil stored in a tranmission case. In an outboard engine arrangement, however, if primary and sub shafts of the transmission are vertically disposed, gears located at upper positions on the primary and sub shafts are completely exposed above the oil surface and for this reason, it is difficult to lubricate these gears with oil splash. In addition, if such gears are also immersed in the oil, substantially all of the transmission is immersed in the oil and hence, resistance to rotation of the transmission is considerably increased, which is not desirable.

SUMMARY OF THE INVENTION

It is an object of the present invention to provide an outboard engine arrangement free from the above disadvantages, and to permit various navigation speeds of a ship even with a compact construction while enabling the transmission to be effectively lubricated.

To accomplish the above object, according to a first aspect of the present invention, there is provided an outboard engine arrangement which comprises an engine; an extension case below the engine; a drive shaft disposed within the extension case to longitudinally extend therein and connected to a crank shaft of the engine for driving a propeller; a transmission interposed between the crank shaft and the drive shaft for shifting a speed change ratio between the both shafts at least at two stages of higher and lower speeds, wherein the crank shaft and the drive shaft are coaxially disposed vertically spaced apart from each other, and the transmission is connected to a lower surface of the engine and contained within an oil pan storing the lubricating oil for the engine.

With the above construction, if the transmission is set for operation at the higher stage, the propeller can be driven at a relatively high speed to assure navigation of the ship at a higher speed, whilst if the transmission is set for operation at the lower stage, the propeller can be driven at a relatively low speed to provide navigation of the ship at an extremely low speed.

Moreover, since the oil pan also serves as a transmission case for the transmission, a simplification in construction is provided.

Further, since the transmission is interposed between the crank shaft and the drive shaft which are coaxially disposed vertically spaced apart from each other, the transmission can be of compact size within the oil pan, thereby avoiding an increase in the size of the extension case.

Further, according to a second aspect of the present invention, there is provided an outboard engine arrangement which comprises an engine provided with a crank case; a transmission below the engine; means for lubricating the transmission; and a propeller below the transmission, wherein the transmission has a vertically extending oil feed bore, and the lubricating means includes a member permitting communication between the oil feed bore and the bottom of the crank case of the engine.

With such construction, lubricating oil which has completed the lubrication of the engine can be introduced from the bottom of the crank case into the oil feed bore of the transmission by way of the aforesaid member of the lubricating means. Therefore, the lubricating oil can be supplied to the upper and lower portions of the transmission to effectively lubricate these portions. Thus, it is possible to reduce that portion of transmission which is immersed in the lubricating oil to a significant extent or completely and to reduce the resistance in rotation of the transmission due to the oil.

The above and other objects, features and advantages of the invention will become apparent from a reading of the following detailed description of the preferred embodiment taken in conjunction with the accompanying drawings.

BRIEF DESCRIPTION OF THE DRAWINGS

The drawings illustrate one embodiment of the present invention, wherein.

DESCRIPTION OF THE PREFERRED EMBODIMENT

Figure 1:
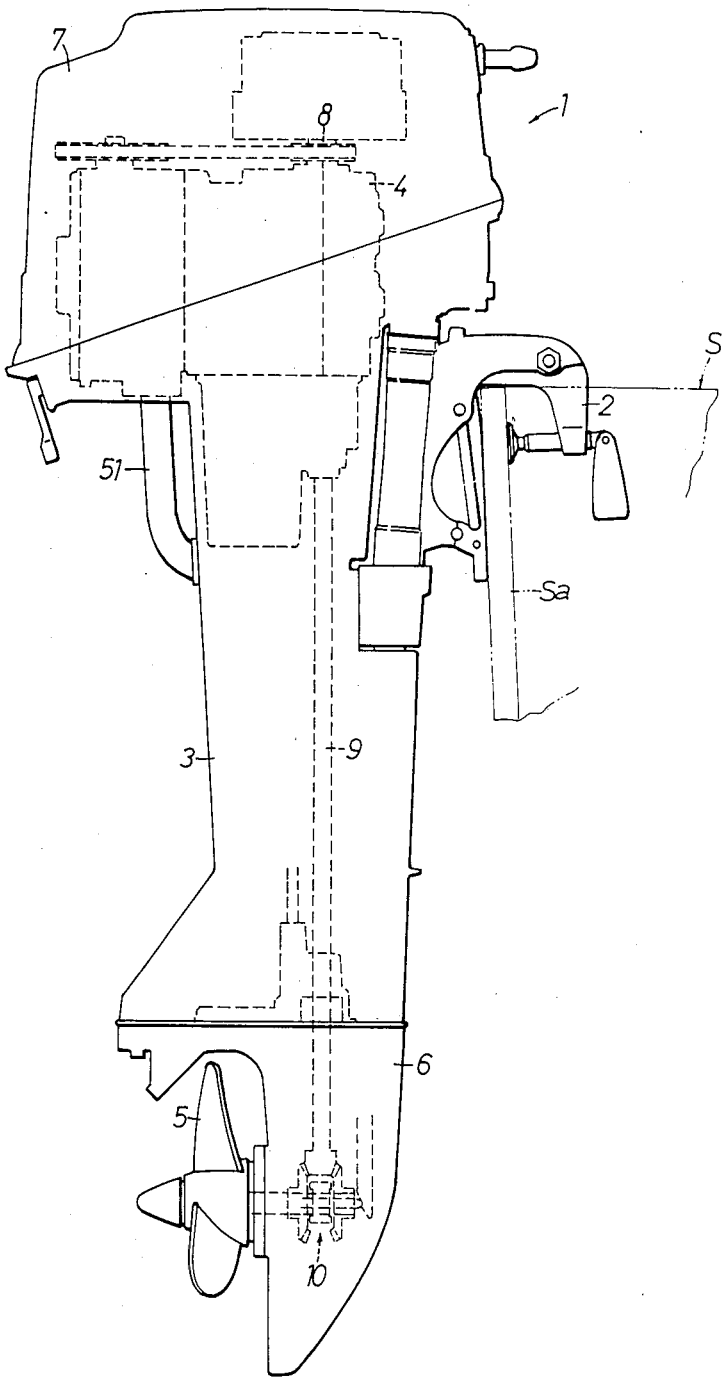
FIG. 1 is a side view of an outboard engine arrangement.

The present invention will now be described in relation to one embodiment with reference to the accompanying drawings. Referring first to FIG. 1, there is shown an outboard engine arrangement 1 which includes an extension case 3 provided at its front portion with a stern bracket 2 clamped to a stern plate Sa of a ship S, an engine 4 mounted on the upper portion of the extension case 3, and a gear case 6 connected to the lower portion of the extension case 3 and having a propeller 5 rotatably supported on the rear wall thereof. An engine cover 7 for covering the engine 4 is mounted on the upper end surface of the extension case 3.

The engine 4 is disposed with a crank shaft 8 directed vertically and a drive shaft 9 driven from the crank shaft 8 is disposed within the extension case 9 to longitudinally extend therein. A forward and reverse change-over gearing 10 is housed within the gear case 6 for driving the propeller 5 from the drive shaft 9 and permitting the changeover of the rotational direction thereof.

Figure 2:
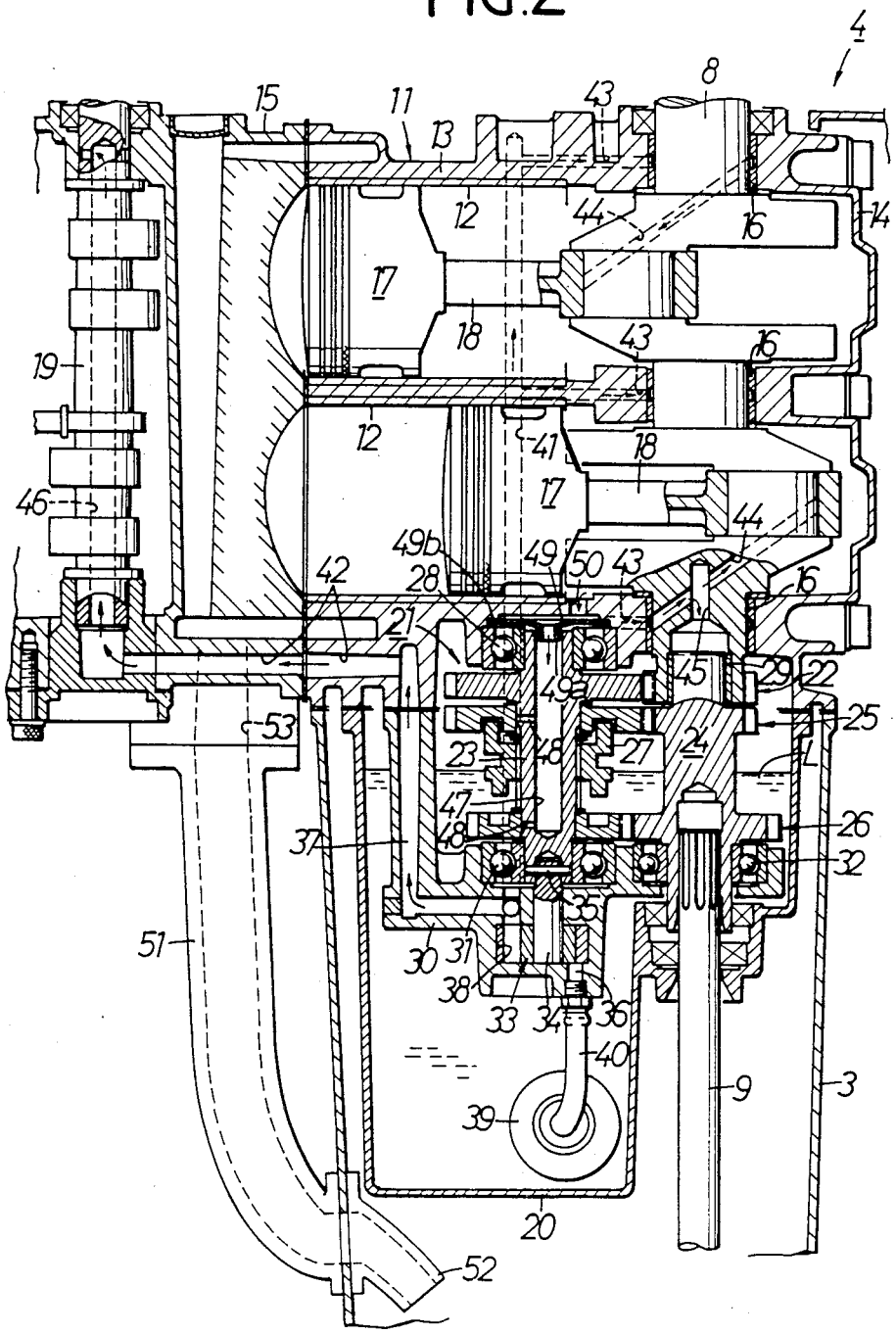
FIG. 2 is a side view in vertical section of an engine portion of the outboard engine arrangement.

Referring to FIG. 2, a body 11 of the engine 4 comprises a cylinder block 13 formed with a pair of upper and lower horizontally extending cylinders 12, a crank case 14 connected to one end face of the cylinder block 13, and a cylinder head 15 connected to the other end face of the cylinder block 13. The cylinder head 15 faces rearwardly of the ship S.

The crank shaft 8 is clamped between the cylinder block 13 and the crank case 14 through three plain bearings 16 equally spaced vertically and crank shaft 8 is connected by connecting rods 18 to pistons 17 slidably received respectively in the cylinders 12.

A cam shaft 19 is carried on the cylinder head 15 for driving intake and exhaust valves (not shown) in each of the cylinders 12.

An oil pan 20 is connected to lower surfaces of the cylinder block 13 and the crank case 14, and a lubricating oil L for the engine 4 is stored in a given quantity in the oil pan 20. In the oil pan 20, the crank shaft 8 and the drive shaft 9 are coaxially disposed in vertically spaced relation and are interconnected through a transmission 21 which is partially immersed in the lubricating oil L.

The transmission 21 is constituted of a primary shaft 23 driven by the crank shaft 8 through a step down gear train 22, a sub-shaft 24 disposed in parallel to the primary shaft 23, a higher speed gear train 25 and a lower speed gear train 26 which are mounted on shafts 23 and 24, and a dog clutch 27 slidably spline-connected to the primary shaft 23 to permit either of the gear trains 25 or 26 to be selectively connected to the primary shaft 23. The primary and sub shafts 23 and 24 are vertically disposed as is the crank shaft 8. The primary shaft 23 is rotatably carried at its upper end on the cylinder block 13 through a ball bearing 28, while the sub-shaft 24 is rotatably carried at its upper end on the hollow portion at a lower end of the crank shaft 8 through a plain bearing 29. The primary and sub shafts 23 and 24 are rotatably carried at their lower ends through bearings 31 and 32 on an Lshaped bracket 30 connected within the oil pan 20 to lower surfaces of the cylinder block 13 and the crank case 14, and the upper end of the sub-shaft 24 is spline-connected to the lower end of the drive shaft 9. Consequently, the sub-shaft 24 is disposed between the crank shaft 8 and the drive shaft 9 in a coaxial relationship with them.

An oil pump 33 is provided on the bracket 30 below the primary shaft 23 and has a pump shaft 34 connected to the primary shaft 23 by a joint pin 35.

The oil pump 33 has an intake port 36 and a discharge port 37 which are defined in the bracket 30 along with a pump housing 38 containing the oil pump 33. Connected to the intake port 36 is an intake pipe 40 connected to an oil filter 39 immersed in the lubricating oil L within the oil pan 20, and connected to the discharge port 37 are a first oil passage 41 defined in a side wall of the cylinder block 13 and a second oil passage 42 defined in lower walls of the cylinder block 13 and the cylinder head 15.

The first oil passage 41 is connected to individual inner peripheral surfaces of the three plain bearings 16 for the crank shaft 8 through three oil feed bores 43 extending from the first oil passage 41, and the inner peripheral surfaces of the uppermost and lowermost plain bearings 16 are in communication with inner peripheral surfaces at larger ends of the connecting rods 18 through oil feed bores 44 in the crank shaft 8. Further, the lower oil feed bore 44 is in communication with an inner peripheral surface of the plain bearing 29 for the sub-shaft 24 through an oil feed bore 45 extending from oil feed bore 44.

On the other hand, the second oil passage 42 communicates with an oil feed bore 46 which is centrally formed in the cam shaft 19 and which communicates with a portion to be lubricated around the cam shaft 19.

An oil feed bore 47 having an upper opened end is formed in the primary shaft 23 at its central portion substantially over the entire length of the shaft 23 and communicates through a plurality of transverse bores 48 to those portions of the higher and lower speed gear trains 25 and 26 which are to be lubricated.

A funnel-shaped oil collector 49 having a central tube 49*a* protruding into the oil feed bore 47 is disposed above the ball bearing 28 which carries the upper end of the primary shaft 23, and a through hole 50 providing communication between the interior of the crank case 14 to and a dish 49*b* of the oil collector 49 is formed in the bottom wall of the engine body 11, i.e., in the side wall of the lower cylinder 12.

The lower surface of the cylinder head 15 is interconnected with the outer rear surface of the extension case 3 by a primary exhaust pipe 51 connected to an exhaust port 53 in the cylinder head 15, and an auxiliary exhaust pipe 52 communicating with a lower end of the primary exhaust pipe 51 and having an opened end directed downwardly is mounted on an inner back surface of the extension case 3 below the oil pan 20. With such a construction, it is possible to form the oil pan 20 with a larger volume while avoiding an increase in size of the extension case 3 due to the primary exhaust pipe 51 and also to discharge exhaust gas into the water through the extension case 3 while preventing the oil pan 20 from being heated by the exhaust gas.

Description will now be made of the operation of this embodiment.

If a shaft operating lever (not shown) is operated during operation of the engine 4 to actuate the dog clutch 27 upwardly, thereby connecting the higher speed gear train 25 to the primary shaft 23, rotational torque transmitted from the crank shaft 8 through the step down gear train 22 to the primary shaft 23 can be transmitted through the higher speed gear train 25 to the sub-shaft 24 and the drive shaft 9, and further through the forward and reverse change-over gearing 10 to the propeller 5 to drive the propeller 5 at a relatively high speed. On the other hand, if the dog clutch 27 is operated downwardly to connect the lower speed gear train 26 to the primary shaft 23, rotational torque of the primary shaft 23 is transmitted through the lower speed gear train 26 to the sub-shaft 24, so that the propeller 5 can be driven at a relatively low speed.

With the higher speed gear train 25 operated, a maximum rotational speed of the propeller 5 is provided upon a maximum output power of the engine 4, so that the ship S can be navigated at a maximum speed. In this case, however, even if the output power of the engine 4 is sufficiently throttled, there is a limit to the reduction of the navigating speed and it is difficult to navigate the ship at an extremely low speed. Thereupon, if the lower speed gear train 26 is now operated to control the output power of the engine 4, the navigation of the ship S at an extremely low speed can be easily achieved, because the rotation of the propeller 5 at a low speed can be freely adjusted.

In addition, if the transmission 21 is shifted as described above depending upon a variation in load of the ship S, i.e., an increase and decrease in the number of crew members and in the cargo, the rotational speed of the propeller corresponding to the load of the ship S is obtained without changing the pitch of the propeller 5, so that the power of the engine 4 can be effectively brought into full output, thereby enabling the ship S to be efficiently navigated.

It is to be noted that since the transmission 21 is contained within the oil pan 20 connected to the lower surface of the engine body 11 and partially immersed in the lubricating oil L, the individual portions of the transmission 21 can be effectively lubricated by oil splash upon the rotation of the gears of the transmission 21 or the like.

In addition, the lubricating oil L within the oil pan 20 is drawn through the oil filter 39 into the oil pump 33 driven from the primary shaft 23 and discharged into the discharge port 37, and then pumped into the first and second oil passages 41 and 42. The oil in the first oil passage 41 is passed through the oil feed bores 43 to the inner surfaces of the plain bearings 16 through which the crank shaft 8 is carried, and further through the oil feed bores 44 to the larger ends of the connecting rods 18 and to the inner surface of the plain bearing 29 through which the subshaft 24 is carried, thus lubricating them.

The oil in the second oil passage 42 is passed through the oil feed bore 46 to lubricated portions around the cam shaft 19.

The oil which has completed the lubrication flows down to the bottom in the crank case 14 and passes through the through hole 50 into the oil collector 49 where this oil is collected. Then, the oil is supplied into the oil feed bore 47 in the primary shaft 23 and flows out through the transverse holes 48 to lubricate lubricated portions around the primary shaft 23 and then returns to the oil pan 20. Therefore, the transmission 21 is effectively lubricated even with the oil which has lubricated the engine 4. In addition, even if the portion of the transmission 21 immersed in the lubricating oil L is reduced to a maximum or completed, the lubrication of the transmission 21 can be conducted without hindrance.

What is claimed is:

1. An outboard engine arrangement, comprising an engine; an extension case below said engine; a drive shaft disposed within said extension case to extend longitudinally therein and connected to a crank shaft of said engine for driving a propeller; a transmission interposed between said crank shaft and said drive shaft for shifting a speed change ratio between said both shafts at least at two stages of higher and lower speeds, an oil pan storing lubricating oil for the engine, said oil pan being connected to said engine at a lower surface thereof, said transmission being contained within said oil pan in sealed relation from the interior of the extension case outside the oil pan.

2. An outboard engine arrangement according to claim 1, wherein said crank shaft and said drive shaft are coaxially disposed with a vertical spacing therebetween, said transmission includes two shafts parallel to each other, one of the transmission shafts being located coaxially with said crank shaft and said drive shaft.

3. An outboard engine arrangement according to claim 1, wherein said transmission is supported within said oil pan on a bracket connected to the lower surface of said engine.

4. An outboard engine arrangement according to claim 2, wherein the two shafts of said transmission are supported at their respective first ends thereof within said oil pan on a bracket connected to the lower surface of said engine.

5. An outboard engine arrangement according to claim 4, wherein said two transmission shafts are vertically disposed and supported at their respective lower ends on said bracket, and one of said shafts is supported at its upper end in a hollow portion of said crank shaft.

6. An outboard engine arrangement according to claim 3, 4 or 5, comprising an oil pump driven by said transmission is mounted in said bracket and a discharge port is defined within said bracket for communicating with lubricated portions of said engine.

7. An outboard engine arrangement according to claim 1 wherein said drive shaft penetrates through the oil pan and is connected to a shaft of said transmission.

8. An outboard engine arrangement comprising an engine including a crank shaft, an extension case secured to said engine to extend therebelow, a drive propeller below said extension case, a drive shaft extending vertically in said extension case, said drive shaft being drivingly connected to said propeller, a transmission connecting said crank shaft and said drive shaft to provide speed change between said shafts for at least two stages of higher and lower speeds, an oil pan containing lubricating oil connected to the engine at a lower surface thereof to occupy a portion of the interior of said extension case and form a sealed chamber within said extension case, said drive shaft projecting from said oil pan into driving relation with the propeller, and means in said oil pan for circulating the lubricating oil between the oil pan and the engine.

9. An outboard engine arrangement according to claim 8 comprising means in said oil pan supporting said transmission from said engine.

10. An outboard engine arrangement according to claim 8 comprising a gear case connected to said extension case in isolation from the oil pan, and a forward and reverse machanism in said gear case drivingly connecting said drive shaft and said propeller.

11. An outboard engine arrangement, comprising an engine provided with a crank case for storing oil therein; a transmission below said engine; means for lubricating said transmission; and a propeller below said transmission, wherein said transmission includes a vertical shaft having a vertically extending oil feed bore, and said lubricating means includes means for guiding oil from the bottom of the crank case into said oil feed bore, said crank case having a through hole in the vicinity of an upper open end of said oil feed bore to connect the bore to the interior of said crank case, said means for guiding oil from the crank case into the oil feed bore comprising a funnel-shaped oil collector comprising a dish located below said through hole and a central tube protruding into said oil feed bore.

12. An outboard engine arrangement according to claim 11, wherein said shaft is provided with a plurality of transverse bores providing communication between the outer periphery of said shaft and said oil feed bore.

13. An outboard engine arrangement according to claim 11 or 12, wherein said transmission includes a second shaft parallel to the first said shaft and coaxial with a crank shaft of said engine, said second shaft being adapted to receive lubricating oil from a passage through which lubricating oil is supplied to said crank shaft.

14. An outboard engine arrangement, comprising an engine provided with a crank case for storing oil therein; a transmission below said engine; means for lubricating said transmission; and a propeller below said transmission, wherein said transmission includes a shaft having a vertically extending oil feed bore, and said lubricating means includes means for guiding oil from the bottom of the crank case into said oil feed bore, said transmission being supported on a bracket within an oil pan connected to a lower surface of said engine.

* * * * *